US007914344B2

(12) United States Patent
Tin et al.

(10) Patent No.: US 7,914,344 B2
(45) Date of Patent: Mar. 29, 2011

(54) DUAL-BARREL, CONNECTOR JACK AND PLUG ASSEMBLIES

(75) Inventors: Suet Fong Tin, Redmond, WA (US); Chee Kiong Fong, Cupertino, CA (US); Jeffrey Griffis, San Carlos, CA (US); Gary Tornquist, Sammamish, WA (US); Farrukh Kamal, Redmond, WA (US); Michael Hiett, Santa Clara, CA (US); Kenneth Budoff, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 12/477,260

(22) Filed: Jun. 3, 2009

(65) Prior Publication Data

US 2010/0311280 A1 Dec. 9, 2010

(51) Int. Cl.
*H01R 33/20* (2006.01)

(52) U.S. Cl. ..... 439/675; 439/668

(58) Field of Classification Search ..... 439/675, 439/668, 680, 674, 677, 63; D13/133
See application file for complete search history.

(56) References Cited

U.S. PATENT DOCUMENTS

| | | | | |
|---|---|---|---|---|
| 4,223,179 | A | 9/1980 | Lusk | |
| 4,759,730 | A * | 7/1988 | Sappington et al. | 439/620.3 |
| 4,950,186 | A | 8/1990 | Kaley | |
| 5,766,020 | A | 6/1998 | Hughes | |
| 5,807,131 | A | 9/1998 | Allen | |
| 5,967,817 | A * | 10/1999 | Greenstein | 439/205 |
| 6,007,352 | A | 12/1999 | Azuma | |
| 6,057,909 | A | 5/2000 | Yahav et al. | |
| 6,074,218 | A * | 6/2000 | Wu et al. | 439/63 |
| 6,100,517 | A | 8/2000 | Yahav et al. | |
| D434,377 | S * | 11/2000 | Bussett et al. | D13/133 |
| 6,196,874 | B1 | 3/2001 | Wu | |
| D453,921 | S * | 2/2002 | Bussett et al. | D13/133 |
| 6,498,628 | B2 | 12/2002 | Iwamura | |
| 6,502,515 | B2 | 1/2003 | Burckhardt et al. | |
| 6,623,277 | B1 * | 9/2003 | Zhu et al. | 439/63 |

(Continued)

FOREIGN PATENT DOCUMENTS

WO WO 99/15863 A1 4/1999

(Continued)

OTHER PUBLICATIONS

Double Barrel Power Cord for AC Adapter, http://www.mobilepowersupply.com, 2002-2008, Mobile Power Supply, 1 page.

(Continued)

*Primary Examiner* — Hae Moon Hyeon
(74) *Attorney, Agent, or Firm* — Woodcock Washburn LLP

(57) ABSTRACT

Disclosed herein are dual-barrel, connector jack and plug assemblies. Particularly, plug assemblies having two single barrel connectors that are situated side-by-side. Each barrel may include two or more contacts for receiving and transmitting DC IN+ electrical signals. Further, each barrel may include two or more contacts for receiving and transmitting DC IN− electrical signals. Inside each barrel connector may be disposed center pins. The barrel connectors may be cylindrically-shaped and configured to mate to a dual-barrel, connector jack assembly as described herein. A bridge component may be disposed between the barrel connectors for preventing the plug assembly from being inserted into the jack assembly in the wrong orientation. The bridge assembly may be shaped to prevent improper insertion into a corresponding aperture of the jack assembly.

14 Claims, 15 Drawing Sheets

U.S. PATENT DOCUMENTS

| | | | | |
|---|---|---|---|---|
| 6,676,443 | B1 * | 1/2004 | Wang | 439/541.5 |
| 6,695,644 | B2 * | 2/2004 | Zhao et al. | 439/580 |
| 6,771,277 | B2 | 8/2004 | Ohba | |
| 6,869,316 | B2 | 3/2005 | Hinkle | |
| 6,932,614 | B1 * | 8/2005 | Kan | 439/580 |
| 6,981,895 | B2 | 1/2006 | Potega | |
| 7,006,236 | B2 | 2/2006 | Tomasi et al. | |
| 7,029,286 | B2 * | 4/2006 | Hall et al. | 439/63 |
| 7,050,177 | B2 | 5/2006 | Tomasi et al. | |
| 7,086,867 | B2 * | 8/2006 | Nakagawa et al. | 439/63 |
| 7,137,825 | B2 * | 11/2006 | Myer et al. | 439/63 |
| 7,151,530 | B2 | 12/2006 | Roeber et al. | |
| 7,224,384 | B1 | 5/2007 | Iddan et al. | |
| 7,293,356 | B2 | 11/2007 | Sohn et al. | |
| 7,306,484 | B1 | 12/2007 | Mahoney | |
| 7,310,431 | B2 | 12/2007 | Gokturk et al. | |
| 7,340,077 | B2 | 3/2008 | Gokturk et al. | |
| 7,651,344 | B2 * | 1/2010 | Wu | 439/80 |
| D616,820 | S * | 6/2010 | Gong et al. | D13/133 |
| 2004/0207597 | A1 | 10/2004 | Marks | |
| 2005/0059488 | A1 | 3/2005 | Larsen et al. | |
| 2006/0188144 | A1 | 8/2006 | Sasaki et al. | |
| 2006/0239558 | A1 | 10/2006 | Rafii et al. | |
| 2007/0013718 | A1 | 1/2007 | Ohba | |
| 2007/0060336 | A1 | 3/2007 | Marks et al. | |
| 2007/0098222 | A1 | 5/2007 | Porter et al. | |
| 2007/0216894 | A1 | 9/2007 | Garcia et al. | |
| 2007/0260984 | A1 | 11/2007 | Marks et al. | |
| 2007/0279485 | A1 | 12/2007 | Ohba et al. | |
| 2007/0283296 | A1 | 12/2007 | Nilsson | |
| 2007/0298882 | A1 | 12/2007 | Marks et al. | |
| 2008/0001951 | A1 | 1/2008 | Marks et al. | |
| 2008/0062257 | A1 | 3/2008 | Corson | |
| 2008/0100620 | A1 | 5/2008 | Nagai et al. | |
| 2008/0126937 | A1 | 5/2008 | Pachet | |
| 2008/0134102 | A1 | 6/2008 | Movold et al. | |
| 2008/0215972 | A1 | 9/2008 | Zalewski et al. | |
| 2008/0215973 | A1 | 9/2008 | Zalewski et al. | |
| 2009/0167679 | A1 | 7/2009 | Klier et al. | |
| 2010/0105226 | A1 * | 4/2010 | Gong et al. | 439/135 |

FOREIGN PATENT DOCUMENTS

| | | | |
|---|---|---|---|
| WO | WO 01/59975 | A3 | 1/2002 |
| WO | WO 02/082249 | A2 | 10/2002 |
| WO | WO 03/001722 | A3 | 3/2003 |
| WO | WO 03/046706 | A1 | 6/2003 |
| WO | WO 03/073359 | A3 | 11/2003 |
| WO | WO 03/054683 | A3 | 12/2003 |
| WO | WO 03/071410 | A3 | 3/2004 |

OTHER PUBLICATIONS

Three-Barrel Power Cord for AC Adapter for Laptops, http://www.upgrademaster.com, 2002-2009, UpgradeMaster, 2 pages.

* cited by examiner

DUAL-BARREL, CONNECTOR JACK AND PLUG ASSEMBLIES

BACKGROUND

Connector jack and plug assemblies are used in the transmission of power and data signals to electronic devices such as, for example, gaming consoles, computer systems, and the like. In addition, connector jack and plug assemblies may be used for receiving data signals from electronic devices. For example, a jack assembly may be configured to interface with a plug assembly for connecting a gaming console to a power supply.

Current barrel-type connectors are cylindrical in shape and are operable to couple the connector plug with the connector jack independent of the orientation of the connector plug with respect to the connector jack. However, current barrel-type connectors can only support one output with a signal pin or two outputs without a signal pin. It is desirable in many applications to provide barrel-type connectors having more than one signal pin and additional outputs.

SUMMARY

Barrel-type connectors having more than one signal pin and additional outputs are disclosed herein. Particularly, the present disclosure relates to plug assemblies having two single barrel connectors that are situated side-by-side. Each barrel may include two or more contacts for receiving and transmitting DC IN+ electrical signals. Further, each barrel may include two or more contacts for receiving and transmitting DC IN− electrical signals. Inside each barrel connector may be disposed center pins, which may be utilized as either an input pin, such as for example, a power enable pin, another input pin, or an output pin. The barrel connectors may be cylindrically-shaped and configured to mate to a dual-barrel, connector jack assembly as described herein.

A bridge component may be disposed between the barrel connectors for preventing the plug assembly from being inserted into the jack assembly in the wrong orientation. The bridge assembly may be shaped to prevent improper insertion into a corresponding aperture of the jack assembly.

Further, the present disclosure relates to dual-barrel, connector jack assemblies. The jack assemblies disclosed herein may include a connector body having two cylindrically-shaped mating apertures. Each mating aperture may include two or more contacts for receiving and transmitting DC IN+ electrical signals. Further, each mating aperture may include two or more contacts for receiving and transmitting DC IN− electrical signals. Further, inside each mating aperture may be disposed center contacts, which extend into the aperture for connecting to a corresponding pin of a plug assembly. The jack assembly may include a bridge aperture that mates to a bridge component of the plug assembly for preventing improper interface to the plug assembly.

A jack assembly disclosed herein may be implemented in a gaming console for connecting the gaming console to a power assembly. The power assembly may include a plug assembly as disclosed herein for interfacing with the gaming console.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The dual-barrel, connector jack assemblies and plug assemblies in accordance with this specification are further described with reference to the accompanying drawings in which.

DETAILED DESCRIPTION OF ILLUSTRATIVE EMBODIMENTS

Exemplary embodiments of the present disclosure may be understood with reference to FIGS. 1-15, wherein like numbers are used to indicate like and corresponding parts.

The present disclosure relates to dual-barrel, connector plug assemblies that overcome shortcomings found in current single barrel electrical connectors. The plug assemblies disclosed herein may include two single barrel connectors situated side-by-side. Each barrel may include two or more contacts for receiving and transmitting DC IN+ electrical signals. Further, each barrel may include two or more contacts for receiving and transmitting DC IN− electrical signals. Further, inside each barrel connector may be disposed center pins, which may be utilized as either an input pin, such as for example, a power enable pin, another input pin, or an output pin. The barrel connectors may be cylindrically-shaped and configured to mate to a dual-barrel, connector jack assembly as described herein.

A bridge component may be disposed between the barrel connectors for preventing the plug assembly from being inserted into the jack assembly in the wrong orientation. The bridge assembly may be shaped to prevent improper insertion into a corresponding aperture of the jack assembly.

Further, the present disclosure relates to dual-barrel, connector jack assemblies. The jack assemblies disclosed herein may include a connector body having two cylindrically-shaped mating apertures. Each mating aperture may include two or more contacts for receiving and transmitting DC IN+ electrical signals. Further, each mating aperture may include two or more contacts for receiving and transmitting DC IN− electrical signals. Further, inside each mating aperture may be disposed center contacts, which extend into the aperture for connecting to a corresponding pin of a plug assembly. The jack assembly may include a bridge aperture that mates to a bridge component of the plug assembly for preventing improper interface to the plug assembly.

Figure 1:
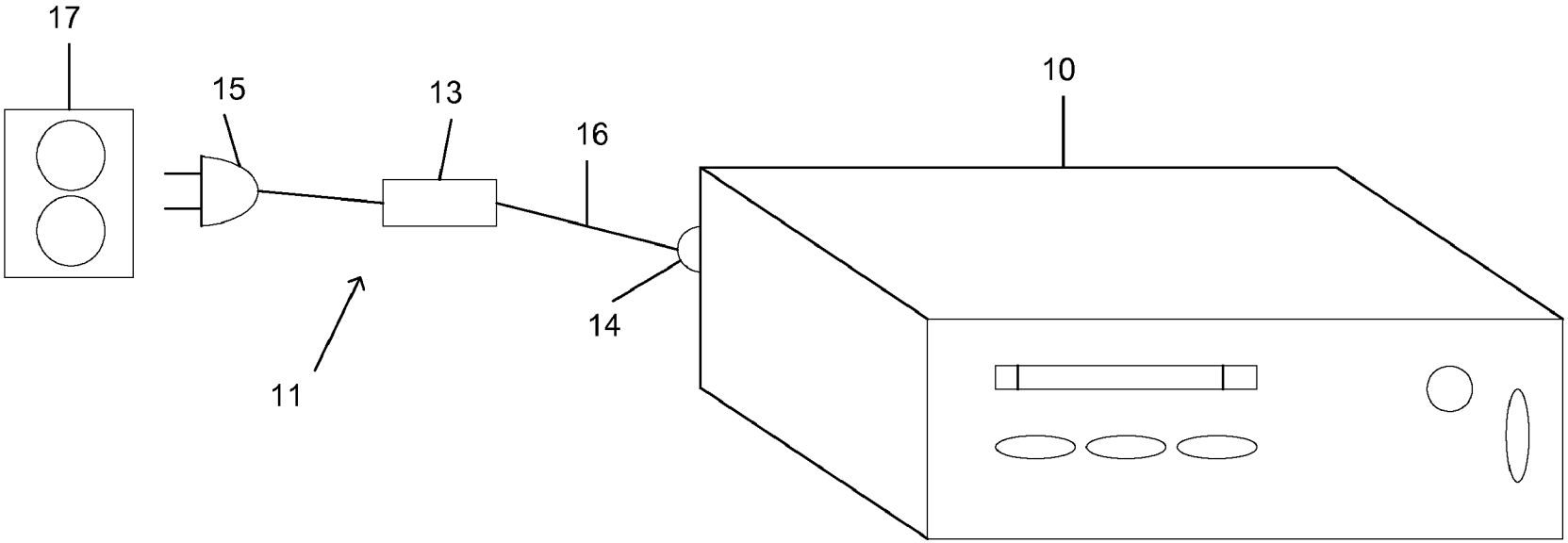
FIG. 1 illustrates a schematic representation of an exemplary gaming console and power assembly utilizing jack and plug assemblies disclosed herein.

A jack assembly disclosed herein may be implemented in a gaming console for connecting the gaming console to a power assembly. The power assembly may include a plug assembly as disclosed herein for interfacing with the gaming console. FIG. 1 is a schematic representation of an exemplary gaming console 10 and power assembly 11 utilizing jack and plug assemblies disclosed herein. Referring to FIG. 1, the power assembly 11 may include an AC adapter 13, a plug assembly 14, a power cord 15, and an electrical cable 16.

The gaming console 10 may alternatively be a computing system or any other suitable electronic device. Further, the gaming console 10 may be plugged into an electrical outlet 17 via the AC adapter 13 to operate on power supplied by the electrical outlet 17. This allows electrical current or power to flow from the electrical outlet 17 through the power cord 15 to the AC adapter 13. The AC adapter 13 receives the AC power signal from the electrical outlet 17 and converts it into a DC power signal that may be used by the gaming console 10. The DC power signal travels from the AC adapter 13 along the electrical cable 16 to the plug assembly 14 to the gaming console 10.

Figure 2:
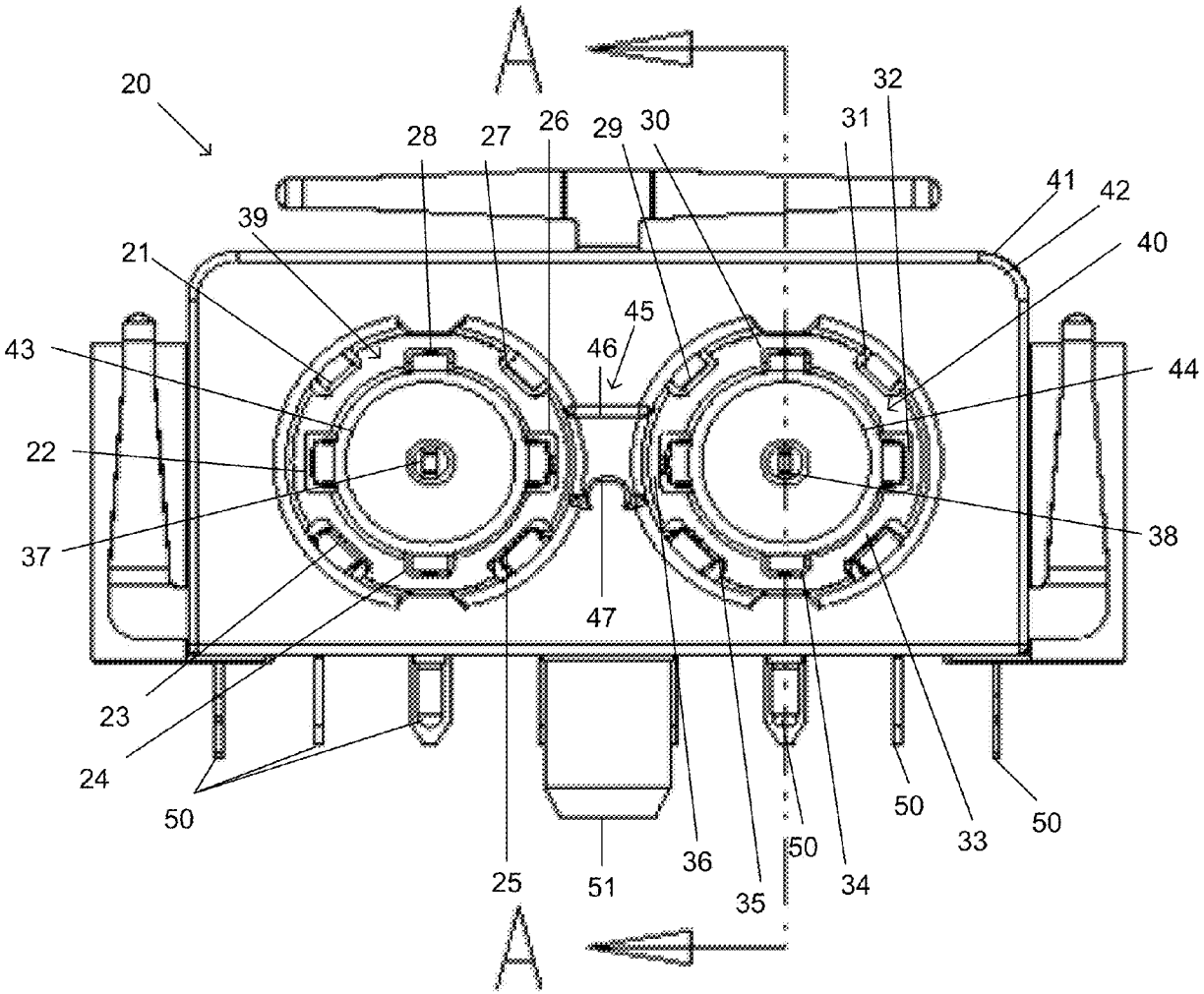
FIG. 2 depicts a front view of an exemplary jack assembly disclosed herein.
Figure 3:
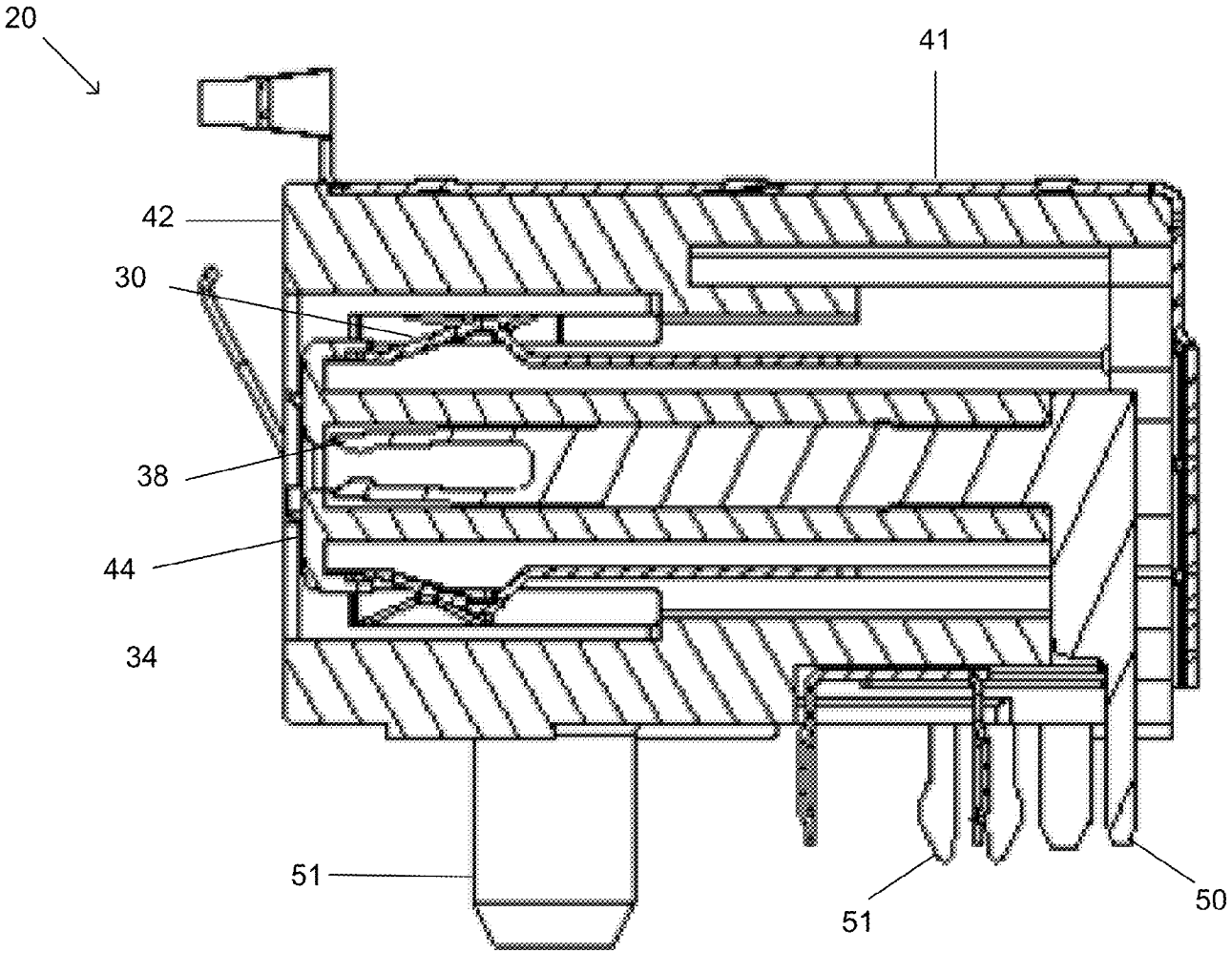
FIG. 3 depicts a sectional view of the jack assembly disclosed herein.
Figure 4:
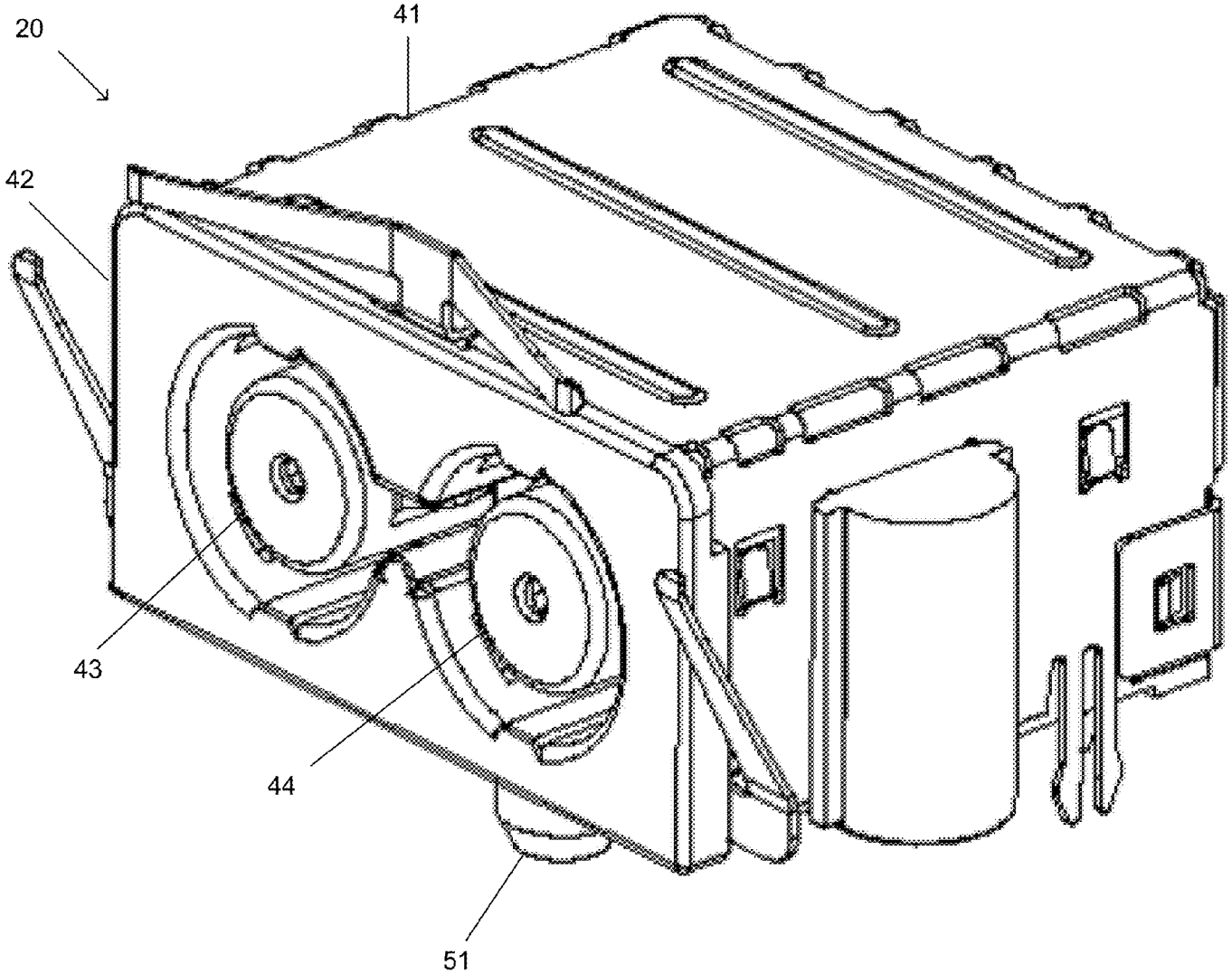
FIG. 4 depicts an isometric view of the jack assembly disclosed herein.
Figure 5:
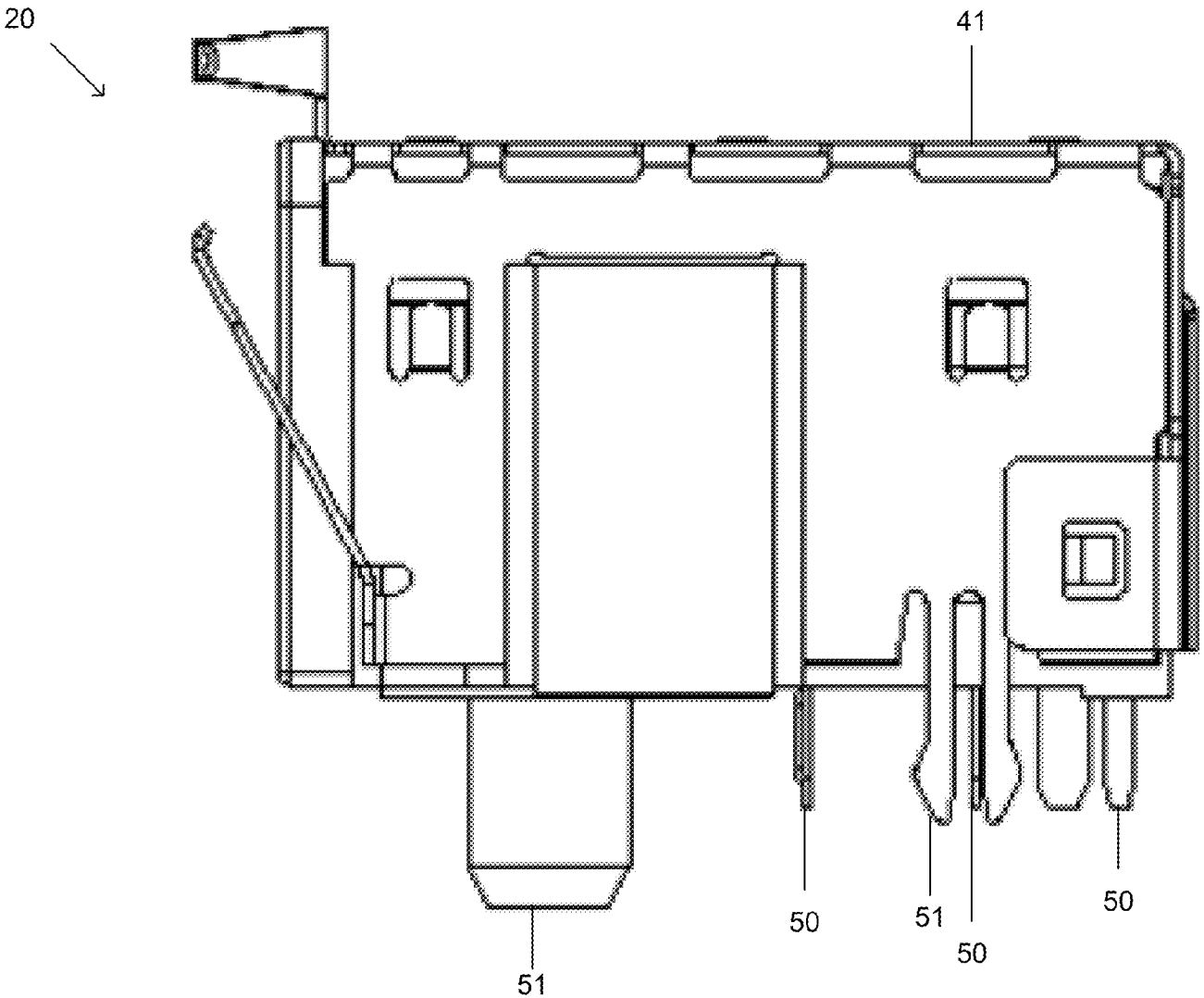
FIG. 5 depicts a side view of the jack assembly disclosed herein.
Figure 6:
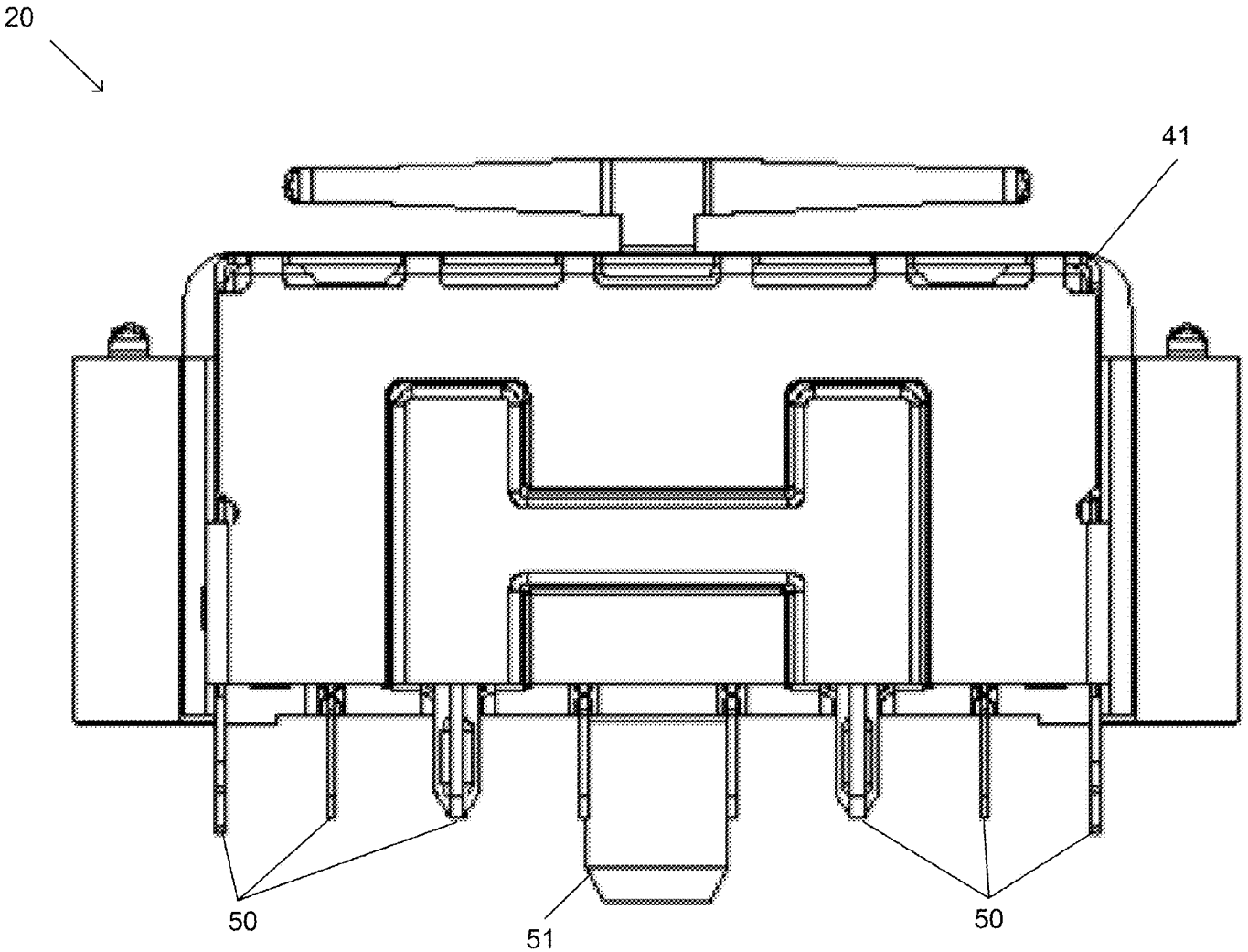
FIG. 6 depicts a rear view of the jack assembly disclosed herein.
Figure 7:
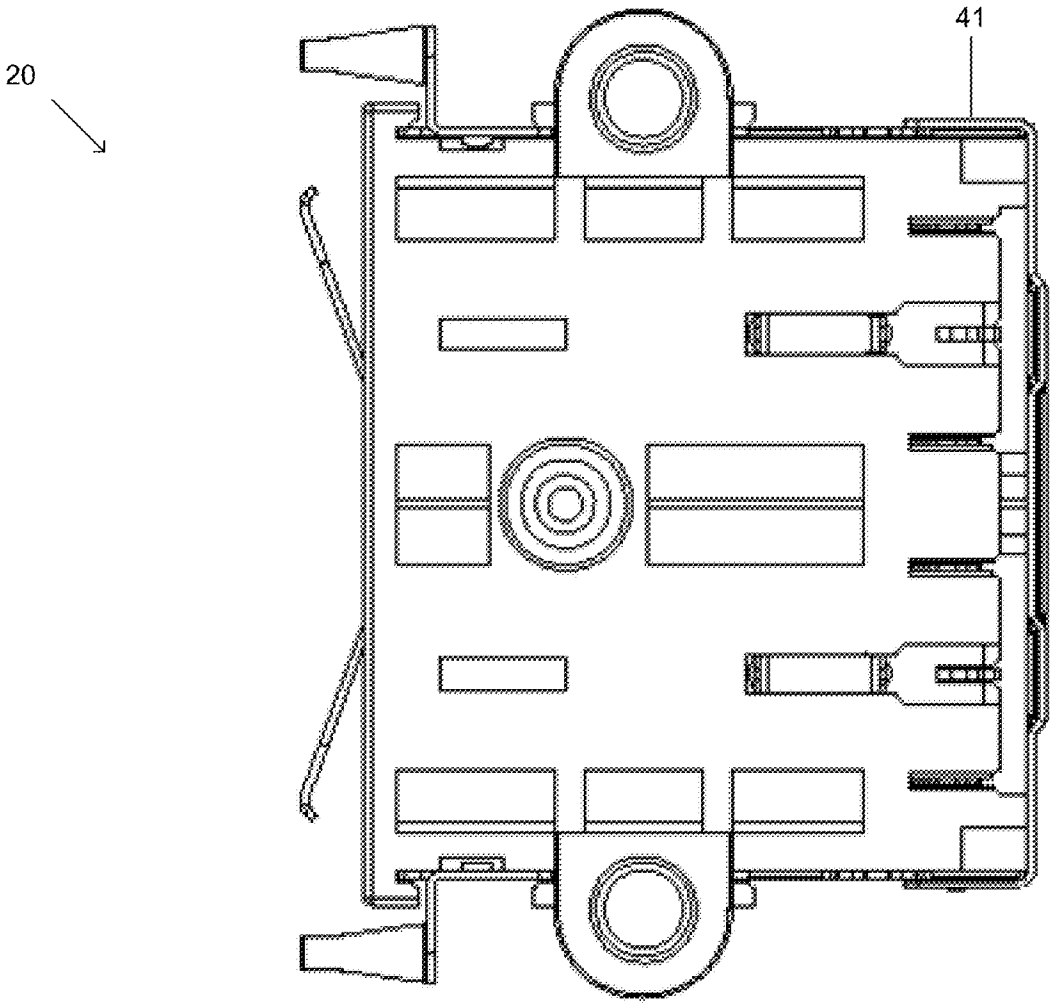
FIG. 7 depicts a bottom view of the jack assembly disclosed herein.
Figure 8:
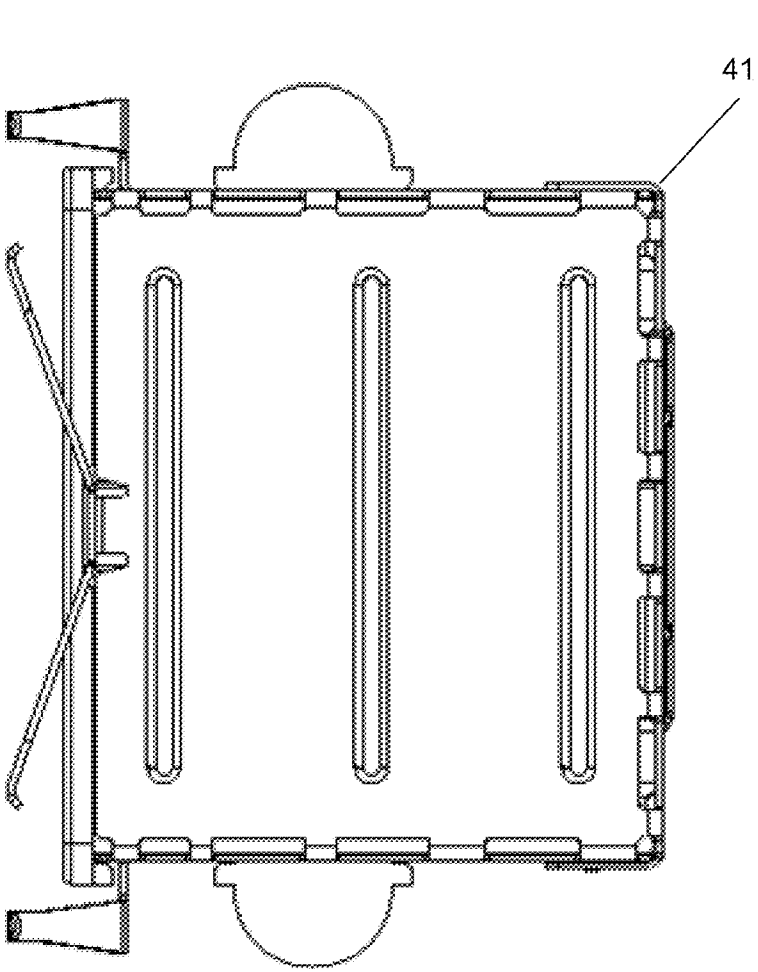
FIG. 8 depicts a top view of the jack assembly disclosed herein.

FIGS. 2-8 illustrate different views of an exemplary embodiment of a dual-barrel, connector jack assembly 20. FIG. 2 depicts a front view of the jack assembly 20, FIG. 3 depicts a sectional view of the jack assembly 20 taken along line A, FIG. 4 depicts an isometric view of the jack assembly 20, FIG. 5 depicts a side view of the jack assembly 20, FIG. 6 depicts a rear view of the jack assembly 20, FIG. 7 depicts a bottom view of the jack assembly 20, and FIG. 8 depicts a top view of the jack assembly 20.

The jack assembly 20 is a receptacle for the plug assembly 14 and operably couples with the plug assembly 14 to provide DC power and data signals to gaming console 10. The jack assembly 20 may include outer contacts 21-36 and center contacts 37 and 38 positioned within cylindrically-shaped mating apertures 39 and 40. The outer contacts 21-36 are operable to receive and transmit any suitable type of electrical signals. Particularly, for example, outer contacts 23 and 25 may be operable to receive and transmit a DC IN− electrical current, outer contacts 33 and 35 may be operable to receive and transmit a DC IN− electrical current, outer contacts 22 and 26 may be operable to receive and transmit a DC IN+ electrical current, and outer contacts 32 and 36 may be operable to receive and transmit a DC IN+ electrical current. The DC IN− contacts in each mating aperture may be paired together as a single DC IN− connector. Similarly, the DC IN+ contacts in each mating aperture may be paired together as a single DC IN+ connector. Each outer contact may be rated for 5 amperes (A). Thus, the DC IN+ connector and DC IN− connector in each barrel may be rated for 10 A.

In an exemplary embodiment, the outer contacts 21, 24, 26, 27, and 28 within the mating aperture 39 and the outer contacts 29-31 and 34 within the mating aperture 40 may function as assistant pins for assisting in the mechanical coupling of the jack assembly 20 to the plug assembly. In this example, the outer contacts are not in electrical communication with the other contacts, but solely assist in the mechanical coupling.

In another exemplary embodiment, the outer contacts 21, 24, 26, 27, and 28 within the mating aperture 39 and the outer contacts 29-31 and 34 within the mating aperture 40 may be in electrical communication with one or more other contacts of the jack assembly 20. For example, the assistant outer contact 21 may be electrically connected to the DC IN− contact 23.

The center contacts 37 and 38 are operable to receive and transmit any suitable type of electrical signals. For example, the center contacts 37 and 38 may receive and transmit data signals. The center contact 37 may be a +5 VSB power supply input. The center contact 38 may be a power enable contact. Further, the center contacts 37 and 38 may be disposed within center apertures.

The contacts 21-28 may be composed of any suitable conductive material. For example, the contacts may be composed of a base metal allow such as a copper alloy or any other appropriate base metal alloy and include a surface plating or coating of silver or any other appropriate plating metal.

The jack assembly 20 may include a jack housing 41 and jack body 42. The housing 41 may be composed of thermoplastic (e.g., thermoplastic UL 94V-0), the like, or other suitable material. The housing 41 may provide grounding for the jack assembly 20 from external electrical sources. For example, the housing 41 may provide a ground for the jack assembly 20 against any static electricity that may build up in the gaming console 10 and therefore prevent an overload due to static electricity.

The jack body 42 is disposed within the jack housing 41 and provides the coupling apparatus for the plug assembly 14 and the jack assembly 20. The jack body 42 may include electrically-insulative material and may be composed of a suitable thermoplastic. Disposed in the jack body 42 are mating apertures 39 and 40 which allow for the coupling of the plug assembly 14 with the jack assembly 20. The jack body 42 may also include inner bodies 43 and 44 having a cylindrical shape and which are positioned within apertures 39 and 40, respectively. The inner bodies 43 and 44 allow for the coupling of the plug assembly 14 with the jack assembly 20. The inner bodies 43 and 44 include center apertures 100 and 101, respectively, which may receive and mate with center pins of the plug assembly 14.

Further, disposed in the jack body 42 is a bridge aperture 45 positioned between the mating apertures 39 and 40. In this example, the bridge aperture 45 may extend between the mating apertures 39 and 40 and connect the spaces between the mating apertures. Alternatively, the bridge aperture 45 may not connect to the mating aperture or may only connect to one of the mating apertures. The bridge aperture 45 may allow for the coupling of the plug assembly 14 with the jack assembly 20.

The bridge aperture 45 may be any suitable size and shape for properly orienting connection of the jack assembly 20 with a plug assembly such that the contacts of the jack assembly connect to the correct contacts of the plug assembly. In other words, the barrels of the plug assembly should be properly fitted within the correct barrel apertures of the jack assembly. For example, the bridge aperture may include opposing surfaces 46 and 47, which are differently shaped for orienting connection of the jack and plug assemblies with one another. In this example, the surface 46 has a flat shape, and the surface 47 has a contoured or rounded shape, such that a bridge component of the plug assembly, described herein, can only fit in single orientation.

The jack assembly 20 may couple with a printed circuit board (PCB) which may be the motherboard of the gaming console 10. The jack assembly 20 and the PCB may include a specific layout of pin connectors for coupling the jack assembly 20 and the PCB and for transmission of electrical current and data signals from the power assembly 11 to the gaming console 10. For example, the jack assembly 20 may include pin connectors 50 for connecting to corresponding pins of the PCB. In addition, for example, the jack assembly 20 may include one or more mounting structures 51 for securing the jack assembly to the PCB or another mounting structure of the gaming console 10.

Figure 9:
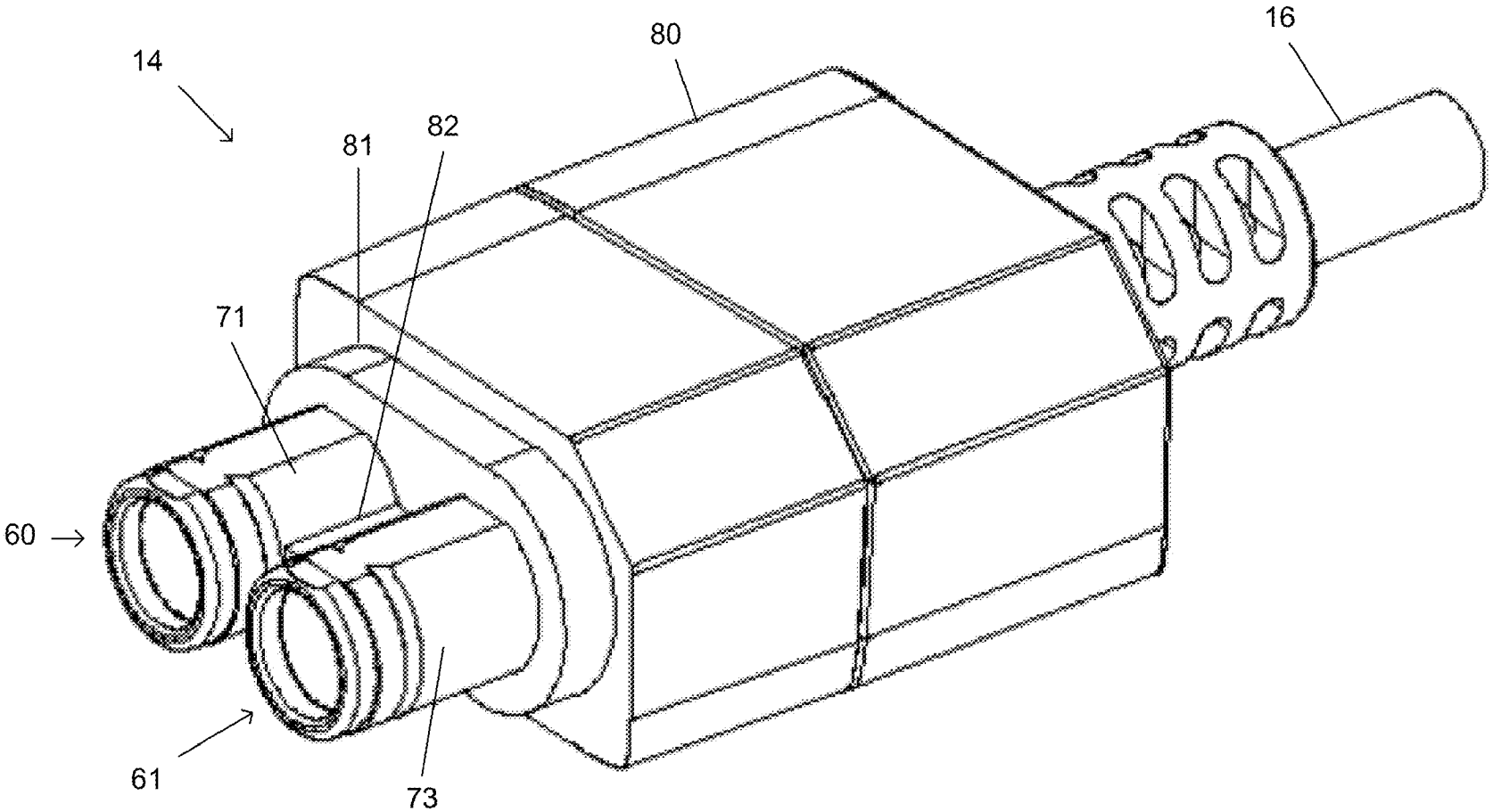
FIG. 9 depicts an isometric view of the plug assembly disclosed herein.
Figure 10:
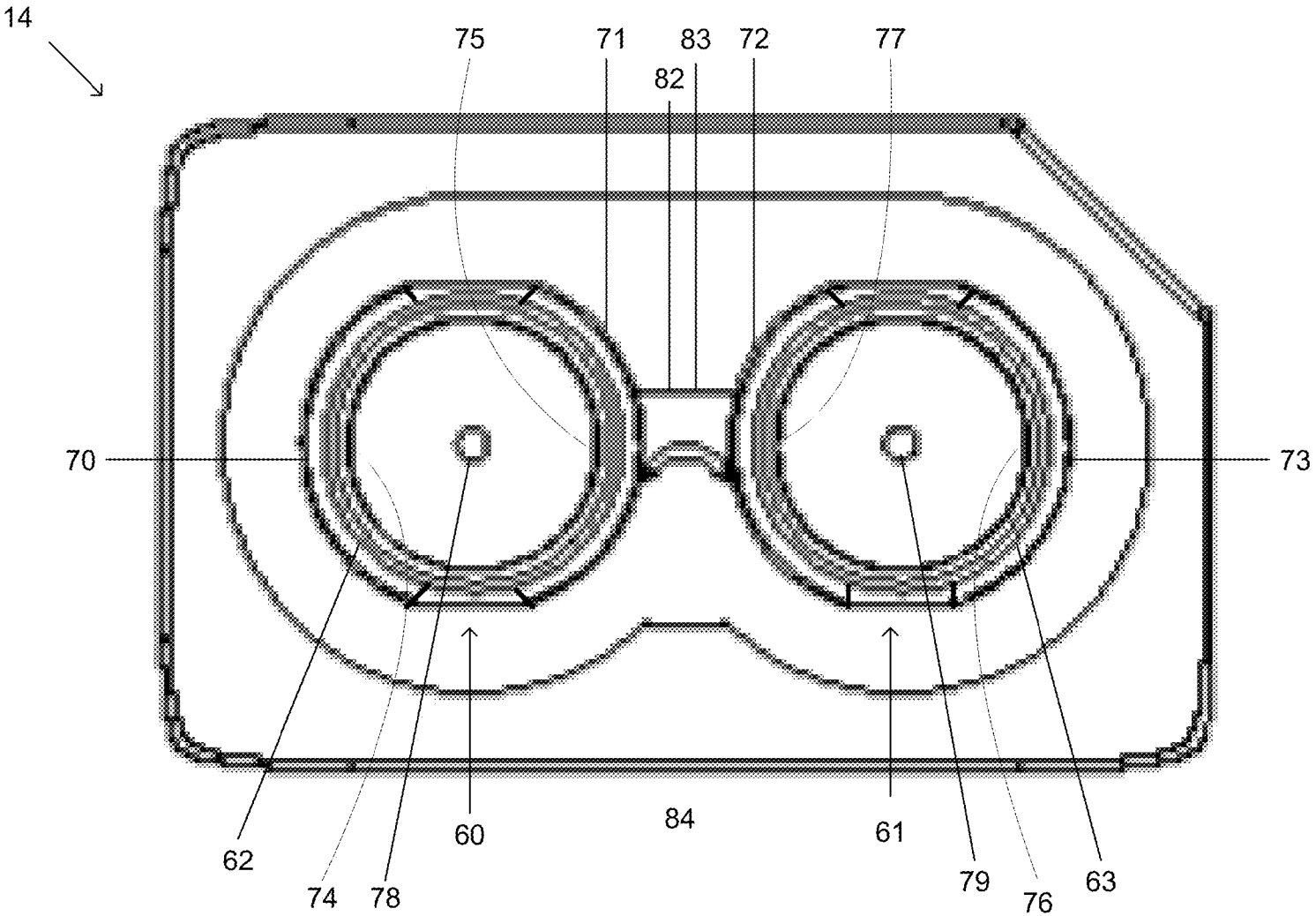
FIG. 10 depicts a front view of the plug assembly disclosed herein.
Figure 11:
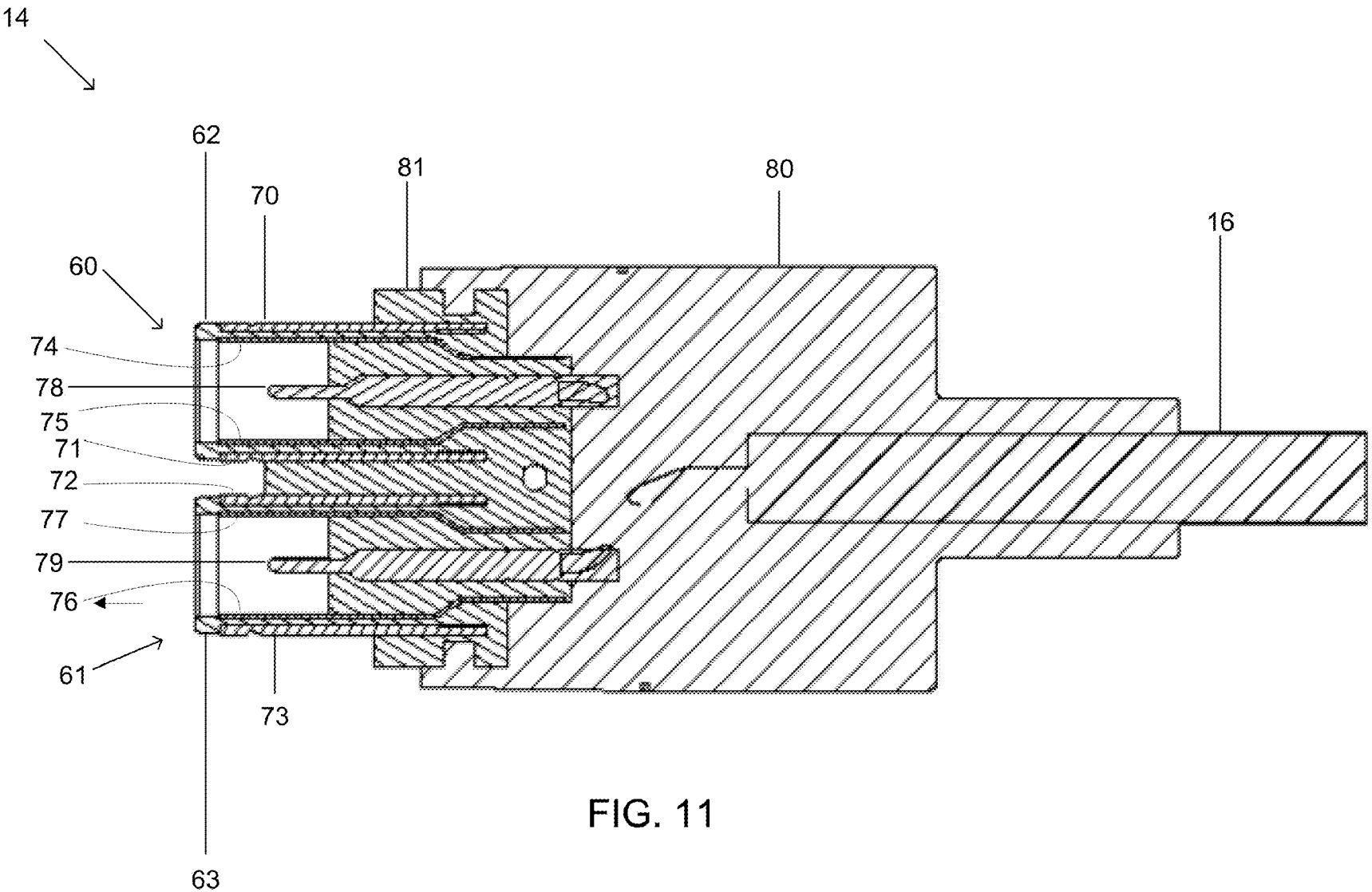
FIG. 11 depicts a sectional view of the plug assembly disclosed herein.
Figure 12:
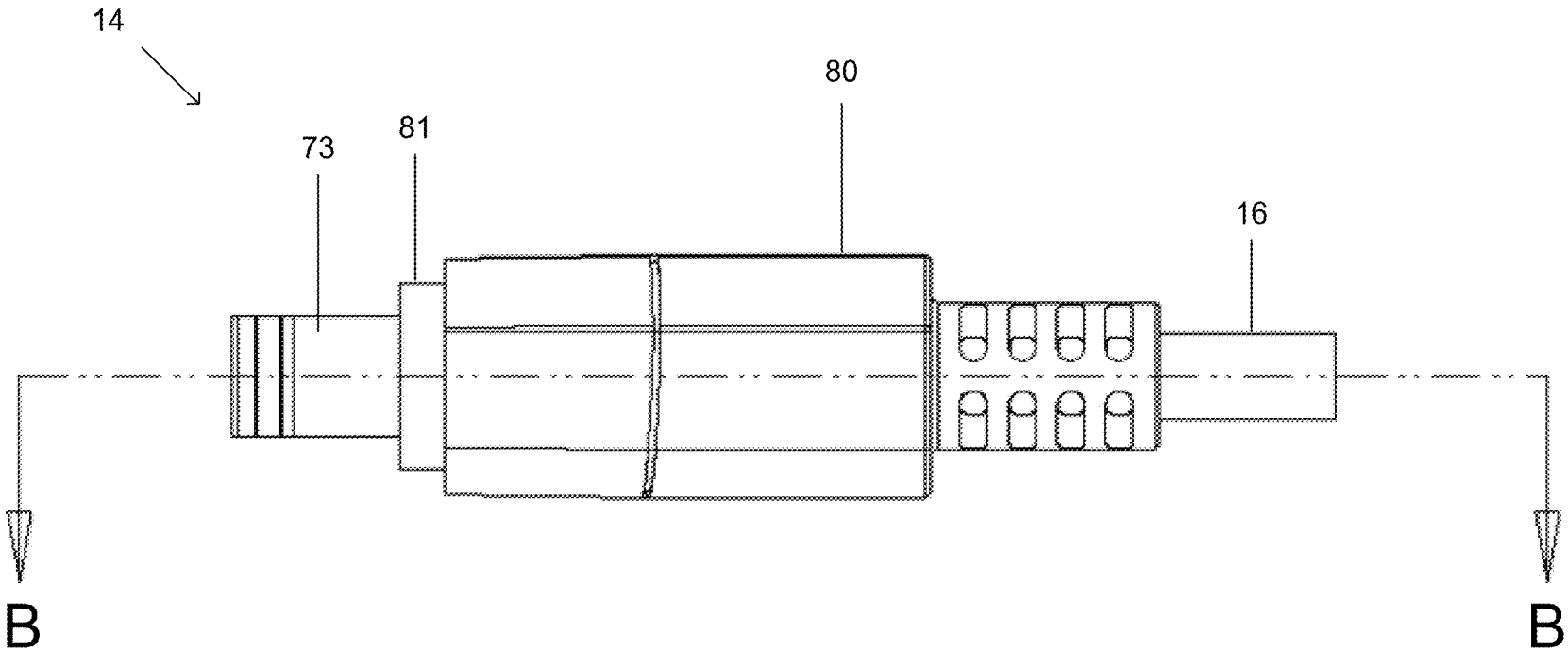
FIG. 12 depicts a side view of the plug assembly disclosed herein.
Figure 13:
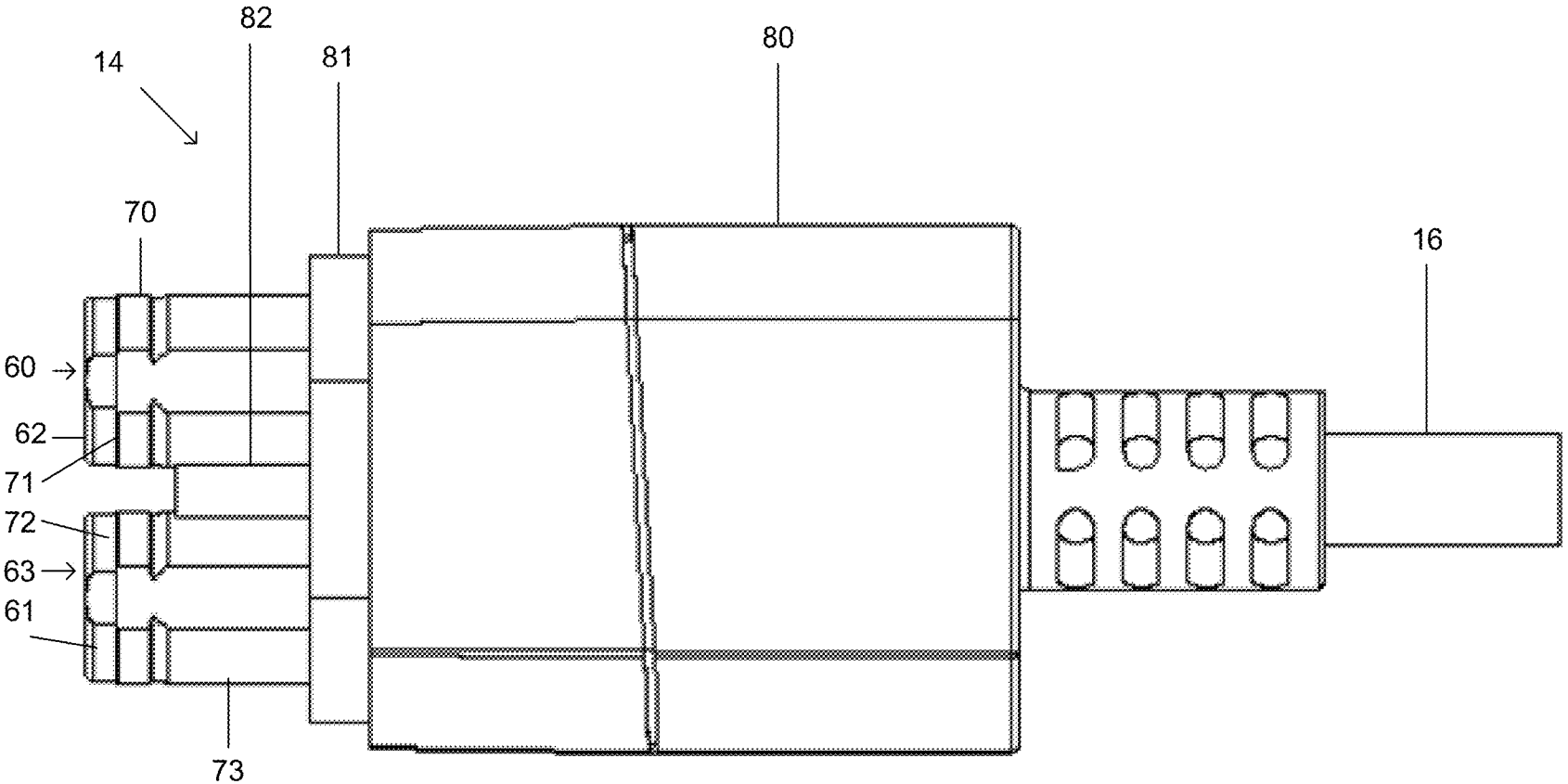
FIG. 13 depicts a top view of the plug assembly disclosed herein.
Figure 14:
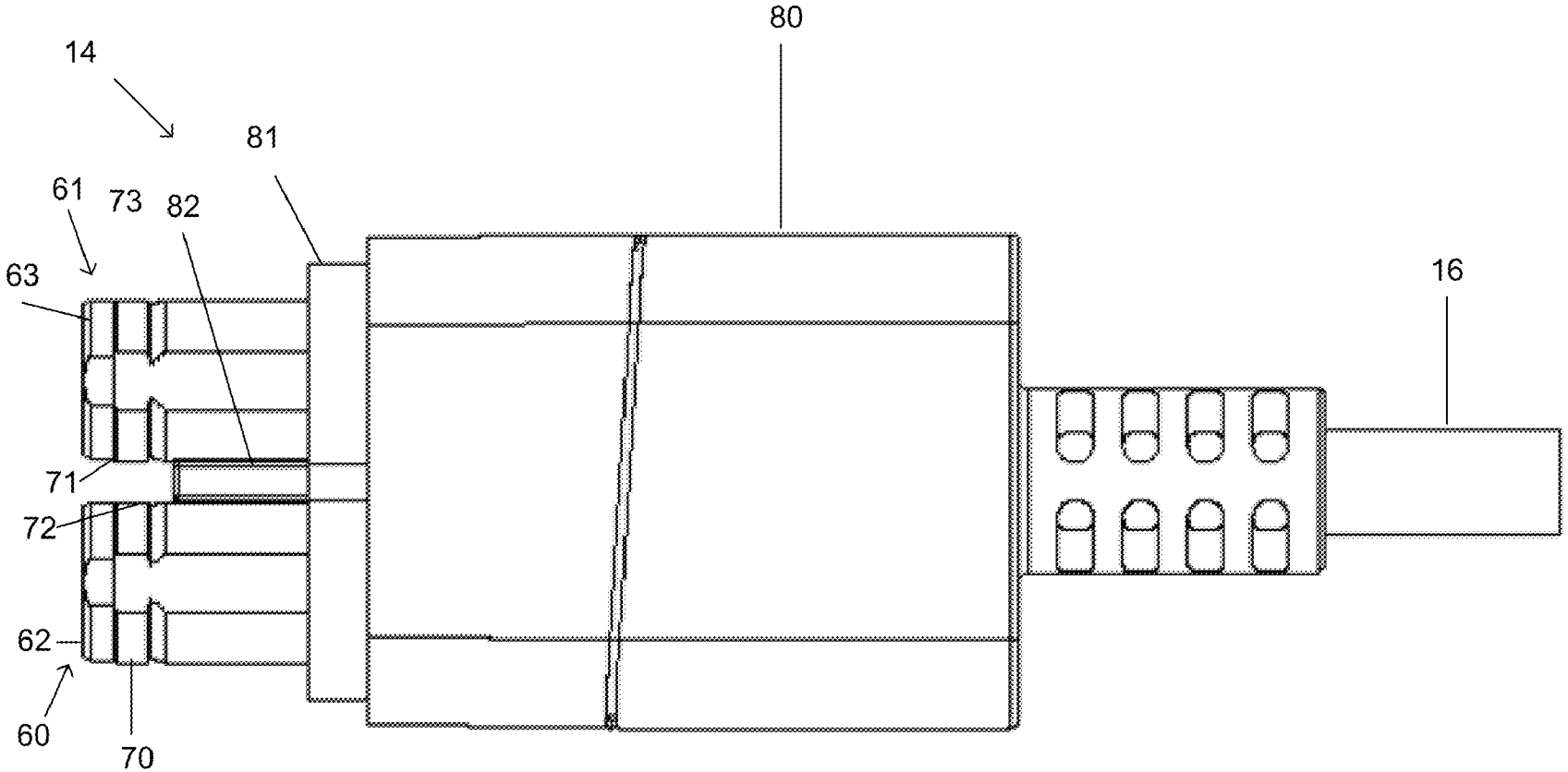
FIG. 14 depicts a bottom view of the plug assembly.
Figure 15:
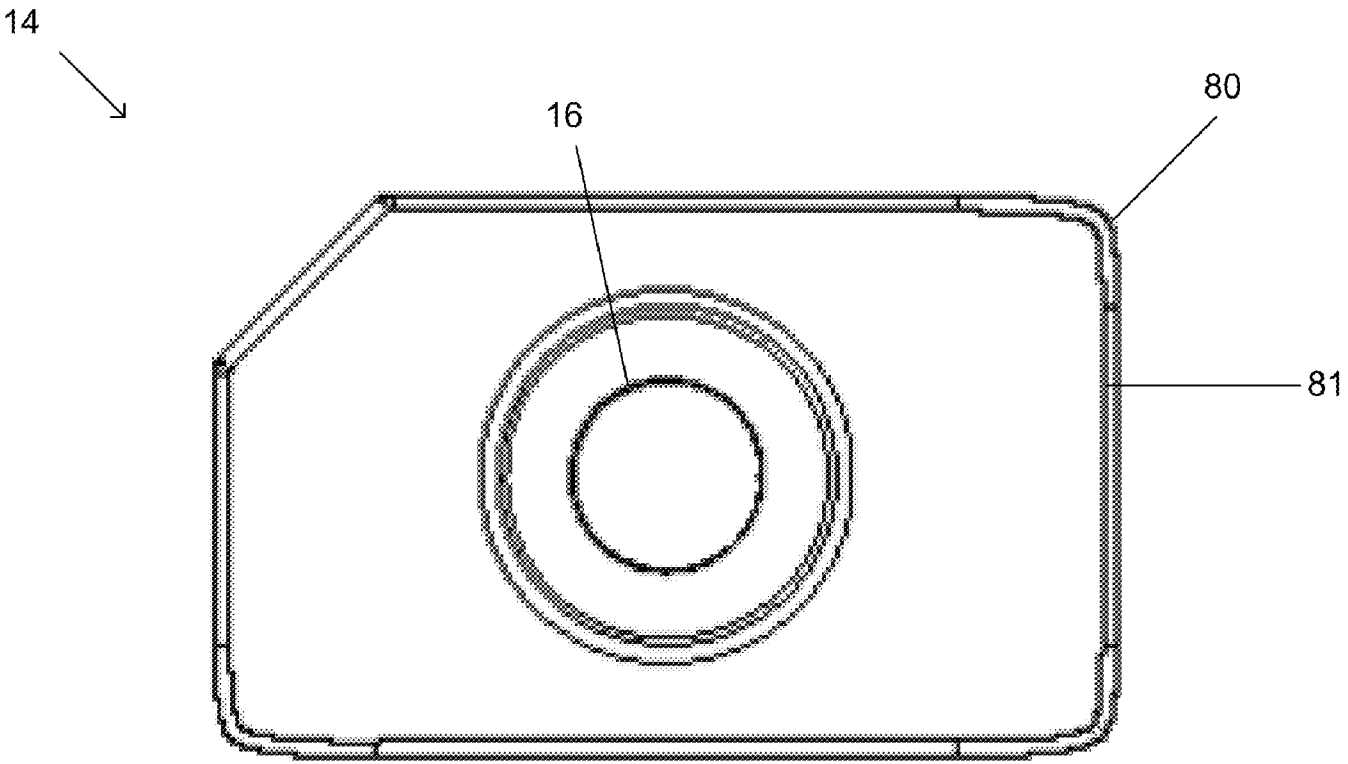
FIG. 15 depicts a rear view of the plug assembly disclosed herein.

FIGS. 9-15 illustrate different views of an exemplary embodiment of the dual-barrel, connector plug assembly 14. FIG. 9 depicts an isometric view of the plug assembly 14, FIG. 10 depicts a front view of the plug assembly 14, FIG. 11 depicts a sectional view of the plug assembly 14 taken along line B, FIG. 12 depicts a side view of the plug assembly 14, FIG. 13 depicts a top view of the plug assembly 14, FIG. 14 depicts a bottom view of the plug assembly 14, and FIG. 15 depicts a rear view of the plug assembly 14.

The plug assembly 14 is used as part of the power assembly 11 to provide DC power and data signals to the gaming console 10. The plug assembly has two barrel-style connectors 60 and 61 having mating bodies 62 and 63, respectively, that may couple with the jack assembly 20. The barrel-style connectors 60 and 61 of the plug assembly 14 may include outer contacts 70-77 and center pins 78 and 79. The contacts 70, 71, 74, and 75 may be attached to the mating body 62. Similarly, the contacts 72, 73, 76, and 77 may be attached to the mating body 63. The mating bodies 62 and 63 may each be cylindrically-shaped and composed of electrically-insulative material such as, for example, thermoplastic (e.g., thermoplastic UL 94V-0), the like, or other suitable material.

The contacts 70-77 are operable to receive and transmit any suitable type of electrical signals. Particularly, for example, outer contacts 70-73 may each be operable to receive and transmit a DC IN− electrical current, and outer contacts 74-77 may each be operable to receive and transmit a DC IN+ electrical current. The insulative mating bodies 62 and 63 prevent electrical communication between the contacts 70-77.

When the plug assembly 14 is coupled to the jack assembly 20, contact 70 of the plug assembly 14 is in electrical communication with the contacts 31 and 33 of the jack assembly 20, contact 71 of the plug assembly 14 is in electrical communication with the contacts 29 and 35 of the jack assembly 20, contact 72 of the plug assembly 14 is in electrical communication with the contacts 25 and 27 of the jack assembly 20, and contact 73 of the plug assembly 14 is in electrical communication with the contacts 21 and 23 of the jack assembly 20. In addition, when the plug assembly 14 is coupled to the jack assembly 20, contact 74 of the plug assembly 14 is in electrical communication with the contacts 30 and 32 of the jack assembly 20, contact 75 of the plug assembly 14 is in electrical communication with the contacts 34 and 36 of the jack assembly 20, contact 76 of the plug assembly 14 is in electrical communication with the contacts 22 and 24 of the jack assembly 20, and contact 77 of the plug assembly 14 is in electrical communication with the contacts 26 and 28 of the jack assembly 20. Thus, by coupling the plug assembly 14 and the jack assembly 20, DC IN+ and DC IN− electrical signals can be communicated between the plug assembly 14 and the jack assembly 20.

Further, when the plug assembly 14 is coupled to the jack assembly 20, pins 78 and 79 of the plug assembly 14 may contact center contacts 38 and 37, respectively. Thus, when the assemblies are coupled, electrical signals may then be communicated between each contact and its respective pin.

The plug assembly 14 may include a plug housing 80 and plug body 81. The housing 80 may be composed of PVC, the like, or other suitable material. The housing 80 may provide grounding for the plug assembly 14 from external electrical sources. For example, the housing 80 may provide a ground for the plug assembly 14 against static electricity.

The plug body 81 is disposed within the plug housing 80 and provides the coupling apparatus for the plug assembly 14 and the jack assembly 20. The plug body 81 may include electrically-insulative material and may be composed of thermoplastic (e.g., thermoplastic UL 94V-0), the like, or other suitable material.

The plug body 81 includes a bridge component 82 which allow for the coupling of the plug assembly 14 with the jack assembly 20. The bridge component 82 may be any suitable size and shape for properly orienting connection of the plug assembly 14 with the jack assembly 20 such that the contacts of the jack assembly connect to the correct contacts of the plug assembly. In other words, the barrels of the plug assembly should be properly fitted within the correct barrel apertures of the jack assembly. For example, the bridge component 82 may include opposing surfaces 83 and 84, which are differently shaped for orienting connection of the jack and plug assemblies with one another. In this example, the surface 83 has a flat shape, and the surface 84 has a contoured or rounded shape, such that a bridge component of the plug assembly, described herein, can only fit in single orientation. For example, the surface 83 of the plug assembly 14 fits to the surface 46 of the jack assembly 20, and the surface 84 of the plug assembly 14 fits to the surface 47 of the jack assembly 20.

It should be understood that the configurations and/or approaches described herein are exemplary in nature, and that these specific embodiments or examples are not to be considered limiting. The specific structures described herein may represent one or more of any number of different applicable structures.

What is claimed:

1. A dual-barrel, connector jack assembly comprising:

a connector body including first and second mating apertures and first and second inner bodies;

first and second outer contacts configured to receive and transmit a first electrical current and positioned within the first and second mating apertures on the first and second inner bodies, respectively;

third and fourth outer contacts configured to receive and transmit a second electrical current different from the first electrical current and positioned on an edge of the first and second mating apertures, respectively; and first and second center contacts extending into the first and second mating apertures, respectively.

2. The jack assembly of claim 1 wherein the connector body comprises insulative material operable to prevent electrical contact between the first and second outer contacts.

3. The jack assembly of claim 1 wherein the first and second mating apertures are each substantially cylindrical in shape.

4. The jack assembly of claim 1 wherein the first and second inner bodies include first and second center apertures in which the first and second center contacts, respectively, are positioned.

5. The jack assembly of claim 4 wherein the inner bodies are each substantially cylindrical in shape.

6. The jack assembly of claim 1 further comprising a bridge aperture positioned between the first and second mating apertures.

7. The jack assembly of claim 6 wherein the bridge aperture extends between the first and second mating apertures.

8. The jack assembly of claim 6 wherein the bridge aperture defines first and second surfaces having different shapes for orienting connection of a dual-barrel, connector plug assembly.

9. A dual-barrel, connector plug assembly comprising:

a plug body including first and second mating bodies each having outside surfaces and each forming an inner aperture;

first and second contacts configured to receive and transmit a first electrical current and positioned on the outside surface of the first and second mating bodies, respectively, on an edge along the inner apertures;

third and fourth contacts configured to receive and transmit a second electrical current different from the first electrical current and positioned on a side of the outside surfaces of the first and second mating bodies, respectively, on an edge opposite to the inner apertures; and first and second center pins positioned within the inner apertures of the first and second mating bodies, respectively.

10. The plug assembly of claim 9 wherein the mating bodies are each substantially cylindrical in shape.

11. The plug assembly of claim 9 wherein the plug body comprises insulative material operable to prevent electrical contact between the first and second contacts.

12. The plug assembly of claim 9 further comprising a bridge component positioned between the mating bodies.

13. The plug assembly of claim 12 wherein the bridge component extends between the outside surfaces of the mating bodies.

14. The plug assembly of claim 12 wherein the bridge component includes first and second surfaces having different shapes for orienting connection to a dual-barrel, connector jack assembly.

* * * * *